US006338708B1

(12) United States Patent
Miura et al.

(10) Patent No.: US 6,338,708 B1
(45) Date of Patent: Jan. 15, 2002

(54) CENTRIFUGE WITH A SUSPENSION FOR LOCATING THE DRIVE IN AN AXIAL DIRECTION

(75) Inventors: Masahiro Miura; Tadashi Ohkawara, both of Hitachinaka; Shinki Ohtsu, Ibaraki-ken, all of (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/613,907

(22) Filed: Jul. 11, 2000

(30) Foreign Application Priority Data

Jul. 15, 1999 (JP) ..... 11-201365
Jun. 27, 2000 (JP) ..... 12-191955

(51) Int. Cl.[7] ..... B04B 9/14
(52) U.S. Cl. ..... 494/82; 74/574
(58) Field of Search ..... 494/1, 7, 9–12, 494/16, 82, 84; 210/144, 363; 74/574; 318/460, 470; 68/23.1, 23.3, 12.06; 73/457, 460, 462

(56) References Cited

U.S. PATENT DOCUMENTS 2,895,023 A * 7/1959 Blum
3,101,322 A * 8/1963 Stallman et al.
3,422,957 A * 1/1969 Fosler
4,079,882 A * 3/1978 Mizuyoshi et al.
4,099,667 A * 7/1978 Uchida
4,214,179 A * 7/1980 Jacobson et al.
4,491,019 A * 1/1985 Wicki et al.
5,160,876 A * 11/1992 Niinai et al.
5,496,254 A * 3/1996 Keller et al.

FOREIGN PATENT DOCUMENTS

DE 216868 * 1/1985
SU 1650256 * 5/1991

* cited by examiner

*Primary Examiner*—Charles E. Cooley
(74) *Attorney, Agent, or Firm*—Louis Woo

(57) ABSTRACT

A centrifuge includes a rotor and a drive device for rotating the rotor. A support frame is located between the rotor and the drive device. A viscoelastic member is provided between the support frame and the drive device. A locating device operates for locating the drive device in an axial direction. The locating device may include a suspension connecting the support frame and a bottom of the drive device. Preferably, the suspension includes one of a wire rope and a piano wire.

9 Claims, 2 Drawing Sheets

CENTRIFUGE WITH A SUSPENSION FOR LOCATING THE DRIVE IN AN AXIAL DIRECTION

BACKGROUND OF THE INVENTION

1. Field of the Invention

This invention relates to a centrifuge including a rotor in which a sample (or samples) to be analyzed is placed, and a drive device for rotating the rotor to separate the sample according to centrifugal force.

2. Description of the Related Art

A general centrifuge or a general centrifugal separator includes a rotor in which a sample (or samples) to be analyzed is placed. A motor-based drive device rotates the rotor at a high speed. The rotor is connected with the drive device via a vertically-extending rotary shaft.

The rotary shaft is designed to be flexible and thin to reduce a bearing load caused by an imbalance in the rotor or an imbalance in the sample arrangement during high-speed rotation of the rotor. Therefore, the spring modulus of the rotary shaft is relatively low.

The drive device is connected with a centrifuge support frame via viscoelastic members. The viscoelastic members have both the spring function and the damping function. For example, the viscoelastic members include suitable combinations of rubber vibration isolators, helical springs, and dampers.

In general, a portion of the body of the centrifuge resonates when the rotor is rotated at one of specified speeds (resonant speeds). The damping function of the viscoelastic members is effective in reducing the amplitude of resonance vibration of the centrifuge body portion which would be increased by an imbalance in the rotor or an imbalance in the sample arrangement.

In the case where the viscoelastic members have a relatively high spring modulus, they hardly deform and hence the damping function thereof tends to be ineffective during rotation of the rotor at a resonant speed. On the other hand, the rotary shaft is whirled or bent considerably out of true through the effect of centrifugal force since the spring modulus thereof is relatively low. Such a bend tends to cause plastic deformation of the rotary shaft or unwanted contact between the outer surface of the rotor and the inner surface of a rotor casing. Accordingly, the viscoelastic members are generally designed to have a relatively low spring modulus. In this case, when the weight of the rotor is great, the viscoelastic members tend to be excessively expanded and be damaged.

SUMMARY OF THE INVENTION

It is an object of this invention to provide an improved centrifuge.

A first aspect of this invention provides a centrifuge comprising a rotor; a drive device for rotating the rotor; a support frame located between the rotor and the drive device; a viscoelastic member provided between the support frame and the drive device; and means for locating the drive device in an axial direction.

A second aspect of this invention is based on the first aspect thereof, and provides a centrifuge wherein the locating means comprises a suspension connecting the support frame and a bottom of the drive device, and the suspension includes one of a wire rope and a piano wire.

A third aspect of this invention is based on the first aspect thereof, and provides a centrifuge further comprising a rotary shaft connected between the rotor and the drive device, wherein a sum of a spring modulus of the viscoelastic member and a spring modulus of the suspension is smaller than a spring modulus of the rotary shaft.

A fourth aspect of this invention is based on the first aspect thereof, and provides a centrifuge wherein the viscoelastic member has a rubber hardness of 35° or less.

A fifth aspect of this invention is based on the first aspect thereof, and provides a centrifuge wherein the suspension has an end including an adjuster for varying a length of the suspension.

A sixth aspect of this invention provides a centrifuge comprising a rotor; a drive device for rotating the rotor; a support frame located between the rotor and the drive device; a viscoelastic member provided between the support frame and the drive device; and a suspension provided between the support frame and the drive device.

A seventh aspect of this invention is based on the sixth aspect thereof, and provides a centrifuge wherein the suspension comprises a wire provided between the support frame and the drive device.

An eighth aspect of this invention is based on the sixth aspect thereof, and provides a centrifuge wherein the suspension comprises an adjuster for varying a length of the suspension.

A ninth aspect of this invention is based on the sixth aspect thereof, and provides a centrifuge further comprising a vertically-extending rotary shaft connected between the rotor and the drive device, wherein a sum of a spring modulus of the viscoelastic member and a spring modulus of the suspension is smaller than a spring modulus of the rotary shaft in a horizontal direction.

DESCRIPTION OF THE PREFERRED EMBODIMENT

A prior-art centrifuge will be explained below for a better understanding of this invention.

Figure 1:
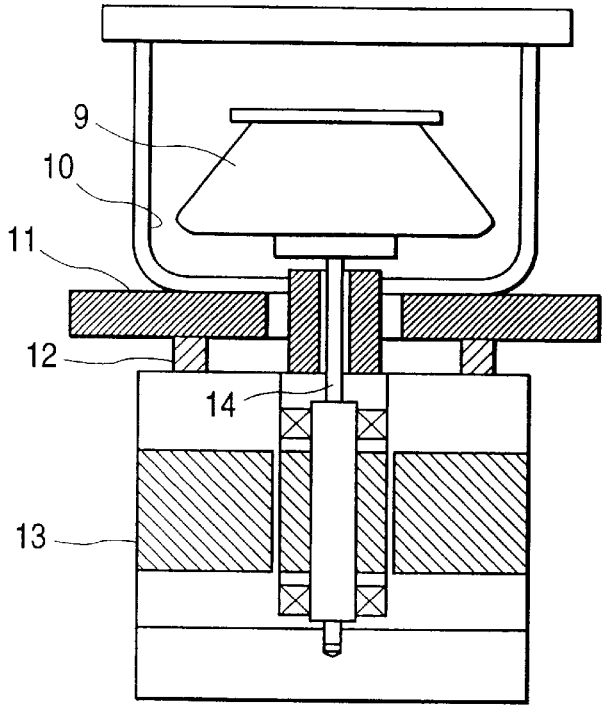
FIG. 1 PRIOR ART
FIG. 1 is a longitudinal section view of a prior-art centrifuge.

With reference to FIG. 1, a prior-art centrifuge includes a rotor 9 disposed in a rotor chamber 10 defined by a rotor casing. A sample or samples to be analyzed are placed in the rotor 9. The prior-art centrifuge also includes a motor-based drive device 13 having a vertically-extending rotary shaft 14. The rotor 9 is mounted on an upper end of the rotary shaft 14. The drive device 13 rotates the rotor 9 at a high speed. The prior-art centrifuge further includes a support frame 11 on which the rotor casing is mounted. A body of the drive device 13 is connected with the support frame 11 via viscoelastic members 12. The viscoelastic members 12 have both the spring function and the damping function. For example, the viscoelastic members 12 include suitable combinations of rubber vibration isolators, helical springs, and dampers.

In the prior-art centrifuge of FIG. 1, the rotary shaft 14 is designed to be flexible and thin to reduce a bearing load caused by an imbalance in the rotor 9 or an imbalance in the sample arrangement during high-speed rotation of the rotor 9. Therefore, the spring modulus of the rotary shaft 14 is relatively low.

A portion of the body of the prior-art centrifuge resonates when the rotor 9 is rotated at one of specified speeds (resonant speeds). The damping function of the viscoelastic members 12 is effective in reducing the amplitude of resonance vibration of the centrifuge body portion which would be increased by an imbalance in the rotor 9 or an imbalance in the sample arrangement.

In the case where the viscoelastic members 12 have a relatively high spring modulus, they hardly deform and hence the damping function thereof tends to be ineffective during rotation of the rotor 9 at a resonant speed. On the other hand, the rotary shaft 14 is whirled or bent considerably out of true through the effect of centrifugal force since the spring modulus thereof is relatively low. Such a bend tends to cause plastic deformation of the rotary shaft 14 or unwanted contact between the rotor 9 and the inner surface of the rotor casing. Accordingly, the viscoelastic members 12 are generally designed to have a relatively low spring modulus. In this case, when the weight of the rotor 9 is great, the viscoelastic members 12 tend to be excessively expanded and be damaged.

Embodiment

Figure 2:
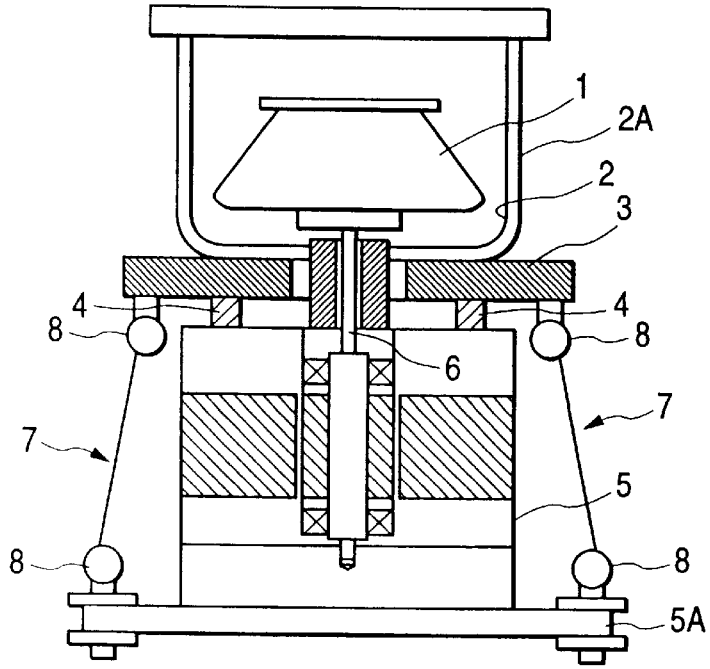
FIG. 2 is a longitudinal section view of a centrifuge according to an embodiment of this invention.

FIG. 2 shows a centrifuge according to an embodiment of this invention. The centrifuge of FIG. 2 includes a rotor 1 disposed in a rotor chamber 2 defined by a rotor casing 2A. A sample or samples to be analyzed are placed in the rotor 1. The centrifuge of FIG. 2 also includes a motor-based drive device 5, and a vertically-extending rotary shaft 6. The rotor 1 is coaxially or concentrically mounted on an upper end of the rotary shaft 6. A lower portion of the rotary shaft 6 concentrically or coaxially extends into the drive device 5. The rotary shaft 6 is rotatably supported by bearings with respect to the drive device 5. The drive device 5 rotates the rotary shaft 6 and the rotor 1. The rotary shaft 6 is designed to be flexible. Thus, the rotary shaft 6 is also referred to as the flexible shaft 6.

The centrifuge of FIG. 2 further includes a support frame 3 on which the rotor casing 2A is mounted. The rotor casing 2A extends above the support frame 3. The support frame 3 is located between the rotor casing 2A and the drive device 5. The support frame 3 extends above and near an outer circumferential portion of the drive device 5. The support frame 3 has a central opening through which the rotary shaft 6 extends. The drive device 5 is suspended to the support frame 3 by viscoelastic members 4 and suspensions 7. The viscoelastic members 4 are provided between the lower surface of the support frame 3 and the upper surface of a body of the drive device 5. The suspensions 7 are provided between outer portions of the support frame 3 and outer portions of a lower end of the body of the drive device 5.

The viscoelastic members 4 are made of suitable material, such as vibration isolating rubber, which has both an elasticity and a viscosity. The suspensions 7 include wire ropes or piano wires. The viscoelastic members 4 and the suspensions 7 are in parallel with each other regarding the drive device 5. The suspensions 7 extend radially outward of the viscoelastic members 4. The lower end of the body of the drive device 5 has an outwardly-projecting bottom flange (a horizontally-projecting bottom flange) 5A. The suspensions 7 connect the outer portions of the support frame 3 and the outer edges of the bottom flange 5A of the drive device 5. The suspensions 7 cause the drive device 5 to have a given degree of freedom to move along a horizontal direction (or a radial direction). The suspensions 7 apply a force to the drive device 5 which constrains the drive device 5 as viewed in a vertical direction. Thus, the suspensions 7 locate the drive device 5 in the vertical direction or the axial direction.

Upper ends of the suspensions 7 are provided with adjusters 8 connected to the support frame 3. Lower ends of the suspensions 7 are provided with adjusters 8 connected to the bottom flange 5A of the drive device 5. The adjusters 8 include screws for adjusting the lengths of the suspensions 7. The adjusters 8 may be omitted from the upper ends of the suspensions 7. Alternatively, the adjusters 8 may be omitted from the lower ends of the suspensions 7.

Figure 3:
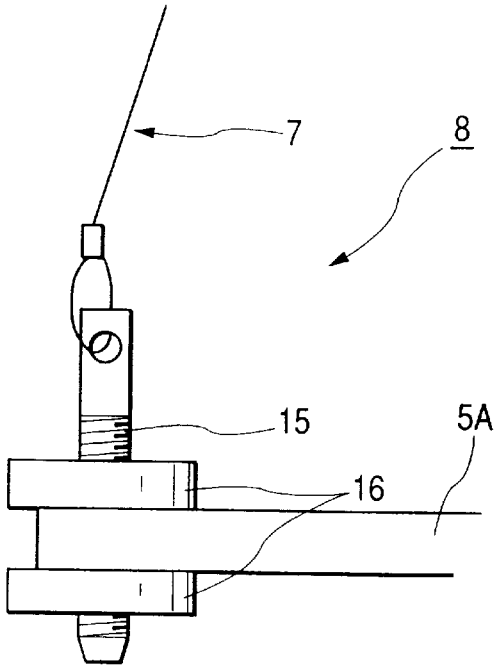
FIG. 3 is a side view of an adjuster in FIG. 2.

The adjusters 8 are similar to each other. Accordingly, only one of the adjusters 8 will be described in more detail. As shown in FIG. 3, the adjuster 8 includes a screw 15 and positioning members 16. The positioning members 16 are rotatably provided on the upper and lower surfaces of the bottom flange 5A of the drive device 5, respectively. The screw 15 extends through threaded holes in the positioning members 16. Thus, the screw 15 engages the positioning members 16. The lower end of the wire in the suspension 7 is connected with an upper end of the screw 15. As the positioning members 16 are rotated, the screw 15 moves axially or vertically so that the length (the vertical length) of the suspension 7 changes. It should be noted that the positioning members 16 may be integral with each other.

A tilt of the drive device 5 can be varied and can be removed by operating the adjusters 8. Preferably, the tilt of the drive device 5 is nullified via the adjusters 8 so that the axes of the drive device 5 and the rotary shaft 6 will be parallel with the direction of the gravity.

The viscoelastic members 4 have a predetermined spring modulus K1 defined in the horizontal direction (or the radial direction). The suspensions 7 have a predetermined spring modulus K2 defined in the horizontal direction (or the radial direction). The rotary shaft 6 has a predetermined spring modulus K defined in the horizontal direction (or the radial direction). Preferably, the spring modulus K3 equal to the sum or resultant of the spring modulus K1 of the viscoelastic members 4 and the spring modulus K2 of the suspensions 7 is smaller than the spring modulus K of the rotary shaft 6. In this case, during rotation of the rotor 1, the drive device 5 is allowed to move (vibrate) in the horizontal direction according to a whirl or a bend of the rotary shaft 6 out of true. Therefore, it is possible to effectively reduce a load on the bearings for the rotary shaft 6 which is caused by an imbalance in the rotor 1 or an imbalance in the sample arrangement. The reduction in the bearing load prevents the occurrence of a plastic deformation of the rotary shaft 6 and a damage thereto.

The viscosity of the viscoelastic members 4 is set to a predetermined great value so that the viscoelastic members 4 can effectively damp the horizontal-direction vibration of the drive device 5, and can provide a sufficient stability of the drive device 5. The suspensions 7 limit the degree of vertical-direction expansion of the viscoelastic members 4, thereby preventing the viscoelastic members 4 from being subjected to loads in the vertical direction (the axial direction). The viscoelastic members 4 can also effectively damp the whirl of the rotary shaft 6.

Figure 4:
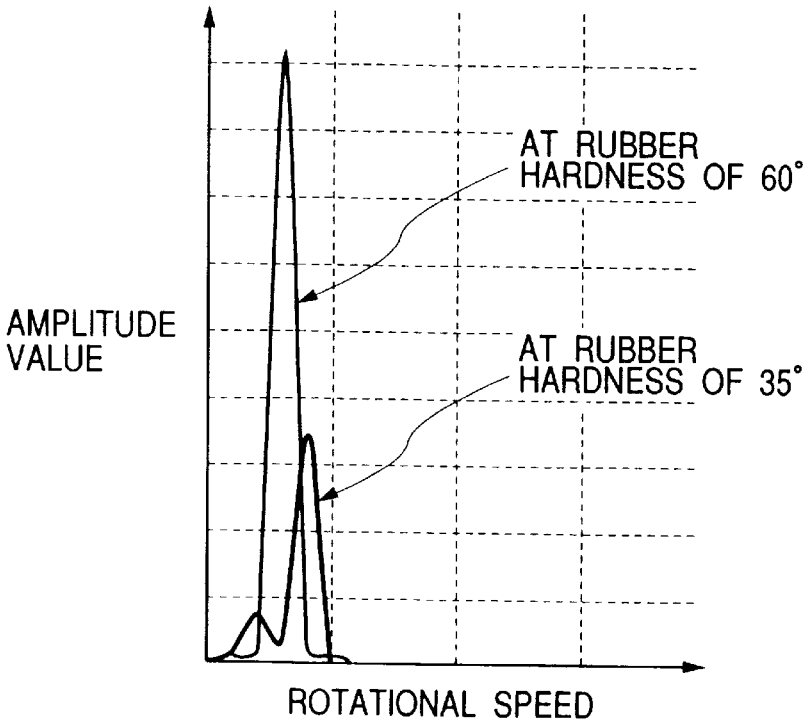
FIG. 4 is a graph of the relation among an amplitude, a rotational speed, and a rubber hardness of viscoelastic members.

The drive device 5 resonates when the rotor 1 is rotated at one of specific speeds (resonant speeds). With reference to FIG. 4, in the case where the viscoelastic members 4 have a rubber hardness of 35° (a relatively low rubber hardness), the amplitude of resonance vibration of the rotor 1 or the rotary shaft 6, which occurs when the rotary shaft 6 rotates at the first resonance speed, is relatively small. Thus, in the case where the viscoelastic members 4 have a rubber hardness of 35°, the amplitude of resonance vibration of the drive device 5 is relatively small. With reference to FIG. 4, in the case where the viscoelastic members 4 have a rubber hardness of 60° (a relatively high rubber hardness), the amplitude of resonance vibration of the rotor 1 or the rotary shaft 6, which occurs when the rotary shaft 6 rotates at the first resonance speed, is relatively great. Thus, in the case where the viscoelastic members 4 have a rubber hardness of 60°, the amplitude of resonance vibration of the drive device 5 is relatively great. Similarly, in the case where the viscoelastic members 4 have a rubber hardness of 45°, the amplitude of resonance vibration of the drive device 5 is great. Preferably, the rubber hardness of the viscoelastic members 4 is equal to or lower than 35°. In this case, the viscoelastic members 4 can effectively damp the horizontal-direction vibration of the drive device 5.

The natural frequency "fvt" of the suspended system which includes the drive device 5 is given as follows.

$$fvt = \frac{1}{2\pi} \cdot \sqrt{\frac{g}{L}} \tag{1}$$

where "g" denotes the gravitational acceleration, and "L" denotes the length of the suspensions 7. It is clear from the above-indicated equation (1) that the natural frequency "fvt" of the suspended system drops as the length "L" of the suspensions 7 decreases. To attain an enhanced effect of damping the horizontal-direction vibration of the drive device 5, it is preferable to increase the length "L" of the suspensions 7.

The centrifuge of FIG. 2 has the following advantages. Even in the case where the rotor 1 is rotated while a great imbalance exists in the rotor 1, the viscoelastic members 4 can sufficiently deform in the horizontal direction, and therefore can effectively damp the horizontal-direction vibration of the drive device 5. The damping effect of the viscoelastic members 4 decreases the amplitude of resonance vibration of the drive device 5. Even in the case where the rotor 1 has a great weight, the degree of vertical-direction expansion of the viscoelastic members 4 can surely be limited by the suspensions 7. Accordingly, the centrifuge of FIG. 2 is able to properly operate even when a great imbalance exists in the rotor 1 or even when the rotor 1 has a great weight. In addition, it is possible to stably and safely rotate the rotor 1. Since the suspensions 7 include the adjusters 8 for varying their lengths, the axes of the drive device 5 and the rotary shaft 6 can be easily and correctly moved into parallel with the direction of the gravity through manipulation of the adjusters 8. Preferably, the length "L" of the suspensions 7 is in a predetermined range where the above-indicated advantages can surely be provided.

What is claimed is:

1. A centrifuge comprising:

a rotor;

a drive device for rotating the rotor;

a support frame located between the rotor and the drive device;

a viscoelastic member provided between the support frame and the drive device; and means connected with the drive device and the support frame for locating the drive device with respect to the support frame in an axial direction.

2. A centrifuge as recited in claim 1, wherein the locating means comprises a suspension connecting the support frame and a bottom of the drive device, and the suspension includes one of a wire rope and a piano wire.

3. A centrifuge as recited in claim 1, further comprising a rotary shaft connected between the rotor and the drive device, wherein the locating means comprises a suspension connecting the support frame and a bottom of the drive device, and a sum of a spring modulus of the viscoelastic member and a spring modulus of the suspension is smaller than a spring modulus of the rotary shaft.

4. A centrifuge as recited in claim 1, wherein the viscoelastic member has a rubber hardness of 35° or less.

5. A centrifuge as recited in claim 1, wherein the locating means comprises a suspension connecting the support frame and a bottom of the drive device, and the suspension has an end including an adjuster for varying a length of the suspension.

6. A centrifuge comprising:

a rotor;

a drive device for rotating the rotor;

a support frame located between the rotor and the drive device;

a viscoelastic member provided between the support frame and the drive device; and means connected with the drive device and the support frame for locating the drive device with respect to the support frame in an axial direction;

wherein the locating means comprises a suspension provided between the support frame and the drive device.

7. A centrifuge as recited in claim 6, wherein the suspension comprises a wire provided between the support frame and the drive device.

8. A centrifuge as recited in claim 6, wherein the suspension comprises an adjuster for varying a length of the suspension.

9. A centrifuge as recited in claim 6, further comprising a vertically-extending rotary shaft connected between the rotor and the drive device, wherein a sum of a spring modulus of the viscoelastic member and a spring modulus of the suspension is smaller than a spring modulus of the rotary shaft in a horizontal direction.

* * * * *